US005947536A

United States Patent [19]

Mizuki et al.

[11] Patent Number: 5,947,536

[45] Date of Patent: Sep. 7, 1999

[54] LATCH DEVICE FOR A TAILGATE OF A VEHICLE

[75] Inventors: Tetsuro Mizuki; Yuji Yoda, both of Yamanashi-ken, Japan

[73] Assignee: Mitsui Kinzoku Kogyo Kabushiki Kaisha, Tokyo, Japan

[21] Appl. No.: 08/957,131

[22] Filed: Oct. 24, 1997

[30] Foreign Application Priority Data

Oct. 25, 1996 [JP] Japan ..... 8-300935

[51] Int. Cl.[6] ..... E05B 65/19

[52] U.S. Cl. ..... 292/201; 292/DIG. 3; 292/DIG. 29

[58] Field of Search ..... 292/144, 201, 292/216, DIG. 3, DIG. 26, DIG. 29, DIG. 43; 296/84.1, 85, 146.8, 96.13

[56] References Cited

U.S. PATENT DOCUMENTS

| | | | |
|---|---|---|---|
| 2,793,907 | 5/1957 | Hess . | |
| 4,157,844 | 6/1979 | Sarosy | 292/48 |
| 4,412,854 | 11/1983 | Hirshberg | 296/146 |
| 4,858,971 | 8/1989 | Haag | 292/201 |
| 5,035,449 | 7/1991 | Shiratori | 292/48 |
| 5,222,775 | 6/1993 | Kato | 292/201 |
| 5,295,374 | 3/1994 | Bender | 20/208 |
| 5,688,004 | 11/1997 | Karge | 292/341.17 |
| 5,694,812 | 12/1997 | Mave | 74/471 R |
| 5,713,613 | 2/1998 | Honma | 292/201 |

FOREIGN PATENT DOCUMENTS

| | | |
|---|---|---|
| 64-022525 | 2/1989 | Japan . |
| 1-223284 | 9/1989 | Japan . |
| 4-037910 | 6/1992 | Japan . |

*Primary Examiner*—Steven Meyers
*Assistant Examiner*—Gary Estremsky
*Attorney, Agent, or Firm*—Browdy and Neimark

[57] ABSTRACT

The invention is directed to a latch device for a tailgate of a vehicle having a motorized unit rotatably located on the tailgate along with a manually operated handle. The motorized unit selectively and through mechanical connections rotates either the main open lever to the latch and unlatch the tailgate or the sub open lever to latch or unlatch the window hatch in the tailgate.

13 Claims, 8 Drawing Sheets

LATCH DEVICE FOR A TAILGATE OF A VEHICLE

BACKGROUND OF THE INVENTION

1. Field of Invention

The present invention relates to a latch device for a tailgate of a vehicle.

2. Prior Art

Japanese Laid-Open (KOKAI) Patent No. 1-223284 and Japanese Published (KOKOKU) Patent No. 4-37910 describe a latch device arrangement for use in a vehicle tailgate having a back door rotatably mounted on a vehicle body and a window hatch rotatably mounted on the back door. The latch device arrangement comprises a main striker fixed to the vehicle body, a main latch assembly provided on the back door for holding the back door in a closed state by engaging with the main striker, a sub striker fixed to the window hatch, a sub latch assembly provided on the back door for holding the window hatch in a closed state by engaging with the sub striker, a main open lever provided on the back door for releasing the main latch assembly from the main striker when rotated, a sub open lever provided on the back door for releasing the sub latch assembly from the sub striker when rotated, an open handle provided on an outer surface of the back door for rotating the main open lever, and a key cylinder provided on the outer surface of the back door, wherein the key cylinder has one end connected to a locking mechanism of the main latch assembly and the other end connected to the sub open lever.

The conventional latch device does not have a motorized opening unit for releasing the main and sub latch assemblies from the main and sub strikers, respectively.

On the other hand, Japanese Laid-Open (KOKAI) Utility Model No. 64-22525 describes a latch device arrangement for a tailgate having a motorized opening unit for rotating main and sub open levers.

However, the conventional device does not have an open handle or a key cylinder to be manually operated for rotating the main and sub open levers.

SUMMARY OF THE INVENTION

Accordingly, an object of the present invention is to provide a latch device for a tailgate of a vehicle having both a motorized means and a manually operating means for rotating main and sub open levers.

Another object of the present invention is to provide a latch device for a tailgate of a vehicle in which the number of parts is reduced by rationally connecting the motorized means and the manually operating means to each other.

DETAILED DESCRIPTION OF THE PREFERRED EMBODIMENTS

Figure 1:
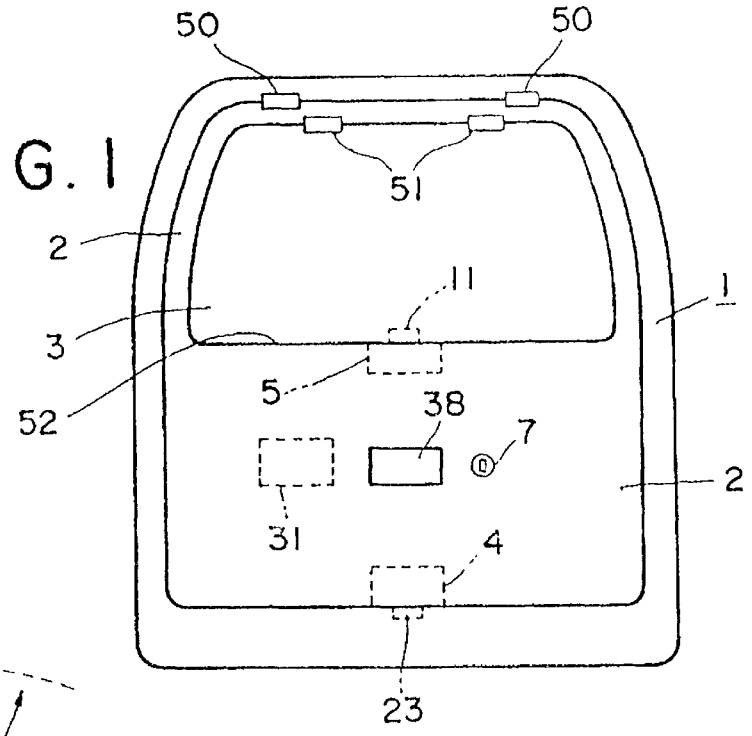
FIG. 1 is a rear view showing the rear face of a vehicle having a tailgate on which a latch device in accordance with in the present invention is provided.
Figure 2:
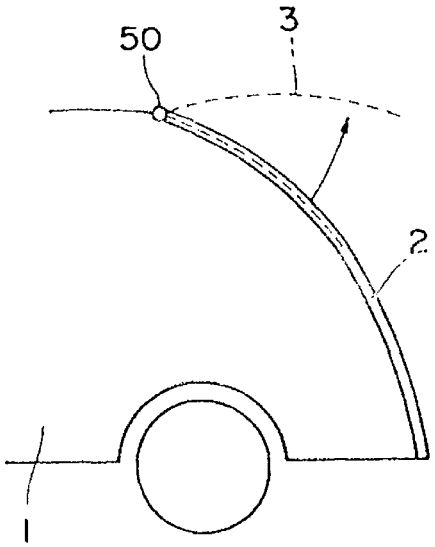
FIG. 2 is a side view showing the latter half of a side face of the vehicle.
Figure 3:
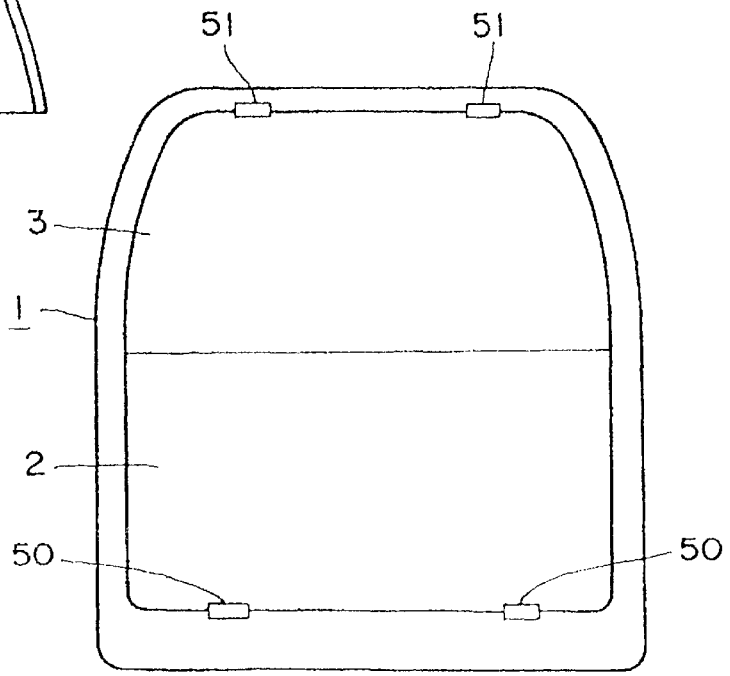
FIG. 3 is a rear view showing another type of the tailgate.

With reference to FIGS. 1 and 2 showing a rear portion of a vehicle, a tailgate of the vehicle is constructed by a back door 2 of which an upper end portion is swingably attached to a vehicle body 1 by hinges 50 and a window hatch 3 which is swingably attached to the back door 2 by hinges 51. The back door 2 is normally made of a metal and the window hatch 3 is normally made of glass. As shown in FIG. 3, there is a case in which the hatch 3 is swingably attached to the vehicle body 1 by the hinges 51. In this case, a lower portion of the back door 2 is swingably attached to the vehicle body 1 by the hinges 50.

In FIG. 1, a main latch assembly 4 having a well-known locking mechanism displaceable between a locked state and an unlocked state is provided at a lower edge of the back door 2. The latch assembly 4 holds the back door 2 in a closed state by engaging with a main striker 23 fixed to the vehicle body 1. A sub latch assembly 5 having no locking mechanism is provided in an edge portion of the back door 2 adjacent to a lower edge 52 of the hatch 3. The sub latch assembly 5 holds the hatch 3 in a closed state by engaging with a sub striker 11 fixed to the lower portion 52 of the hatch 3. Attaching positions of the sub latch assembly 5 and the sub striker 11 can be replaced With each other as described later.

The back door 2 further has a key cylinder 7 connected to the main and sub latch assemblies 4 and 5, an open handle 38 for releasing the main latch assembly 4, and a motorized opening unit 31 for releasing the latch assemblies 4 and 5.

Figure 4:
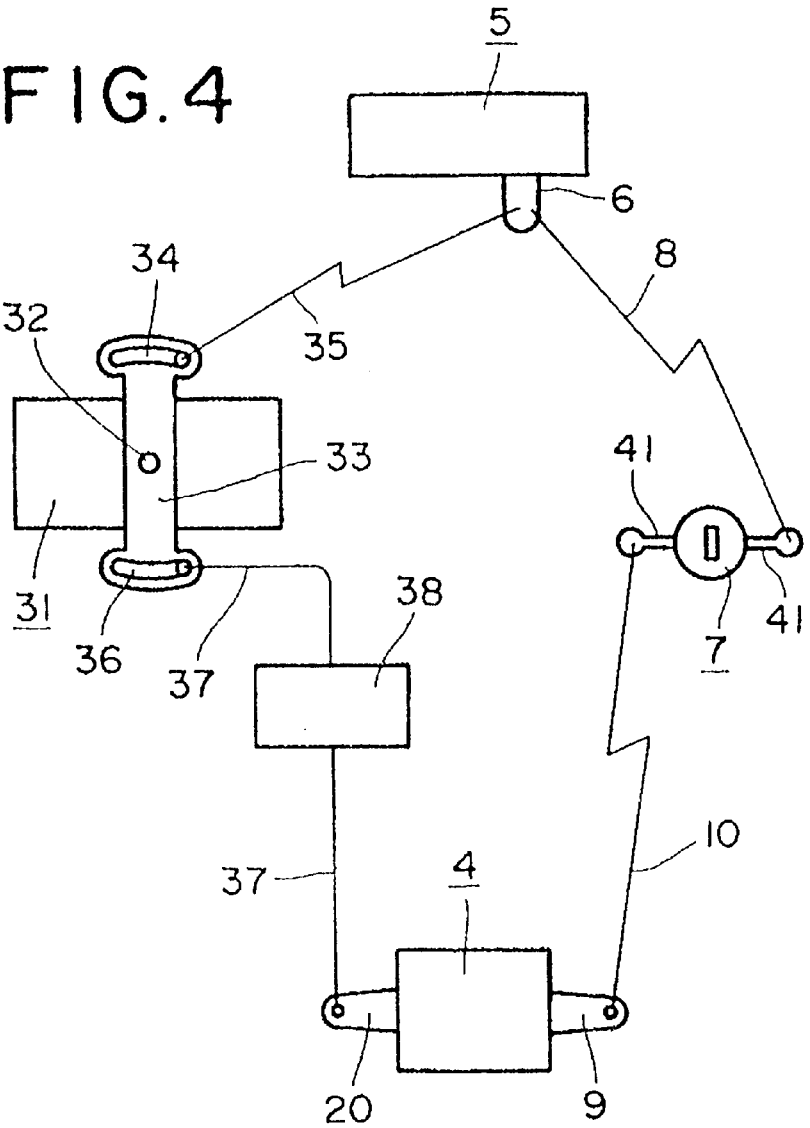
FIG. 4 is a schematic view showing a connecting relation of components of the latch device.
Figure 12:
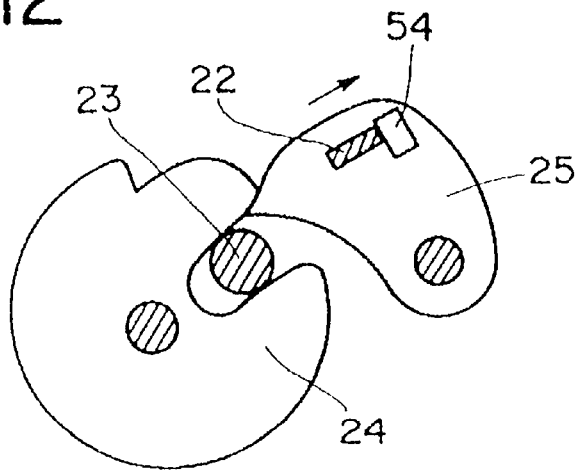
FIG. 12 is a plan view showing a latch and a ratchet of the main latch assembly.

FIG. 4 schematically shows the connecting relation of components of the latch device shown in FIG. 1. One end of a rod 10 is connected to a lock lever 9 for displacing the locking mechanism of the main latch assembly 4 to the locked state and the unlocked state, and the other end of the rod 10 is connected to a key lever 41 which is rotated integrally with the key cylinder 7. One end of a rod 8 is connected to an open lever 6 for releasing the sub latch assembly 5 from the sub striker 11, and the other end of the rod 8 is connected to the key lever 41. In the present invention, as univocally shown in FIG. 16A, when the key cylinder 7 is rotated by a key operation in the direction of an arrow X, the sub latch assembly 5 is released from the sub striker 11 to open the window hatch 3. At the same time, the locking mechanism of the main latch assembly 4 is switched to the unlocked state. To the contrary, when the key cylinder 7 is rotated in the direction of an arrow Y, the locking mechanism of the main latch assembly 4 is switched to the locked state. However, the relation of the key cylinder 7 and the latch assemblies 4, 5 can be freely set by changing a connecting relation of the rods 8, 10 and the key cylinder 7, etc. FIGS. 16B to 16E show one example of this connecting relation.

With reference to FIG. 4, one end of a rod 35 is connected to a lever 33 of the motorized opening unit 31, and the other end of this rod 35 is connected to the open lever 6. One end of a wire cable 37 is connected to the lever 33, and the other end of the cable 37 is connected to an open lever 20 for releasing the main latch assembly 4 from the striker 23 by way off the open handle 38. In this construction, when the opening unit 31 pulls the rod 35, the sub latch assembly 5 is released from the striker 11, and when the opening unit 31 pulls the cable 37, the main latch assembly 4 is released from the striker 23. Further, as described later, the cable 37 is also pulled by rotation of the open handle 38 so that the main latch assembly 4 is released. The motorized opening unit 31 is arranged so that it is operated on the basis of operating signals from a switch 47 (described later in detail) for detecting an opening operation of the open handle 38, an operating switch (not shown) provided in the vicinity of a driver's seat of the vehicle, or a transmitter (not shown) for remote control, etc.

The construction of the main latch assembly 4 will be explained in detail with reference to FIGS. 5 to 12. The main latch assembly 4 has a latch 24 which is engageable with the main striker 23, and a ratchet 25 which is engageable with the latch 24 so as to hold the engagement between the latch 24 and the striker 23. The latch 24 and the ratchet 25 are rotatably attached to a frame 17 of the latch assembly 4. A shaft 26 is provided in a projecting piece 43 of the frame 17. A ratchet lever 22 and the open lever 20 are pivotally mounted to the shaft 26. A tip end 53 of the ratchet lever 22 is opposed to a projection 54 of the ratchet 25 so that the ratchet 25 is released from the latch 24 when the ratchet lever 22 is rotated.

The ratchet lever 22 has an elongated slot 30 extending in a radial direction of the shaft 26. The open lever 20 has a groove 44 constructed by a lost-motion groove 27 and an engaging groove 28. The lost-motion groove 27 is formed in an arc shape centered on an axis of the shaft 26. The engaging groove 28 extends in the radial direction of the shaft 26 from an end portion of the groove 27 and is substantially overlapped with the elongated slot 30 of the ratchet lever 22.

Figure 5:
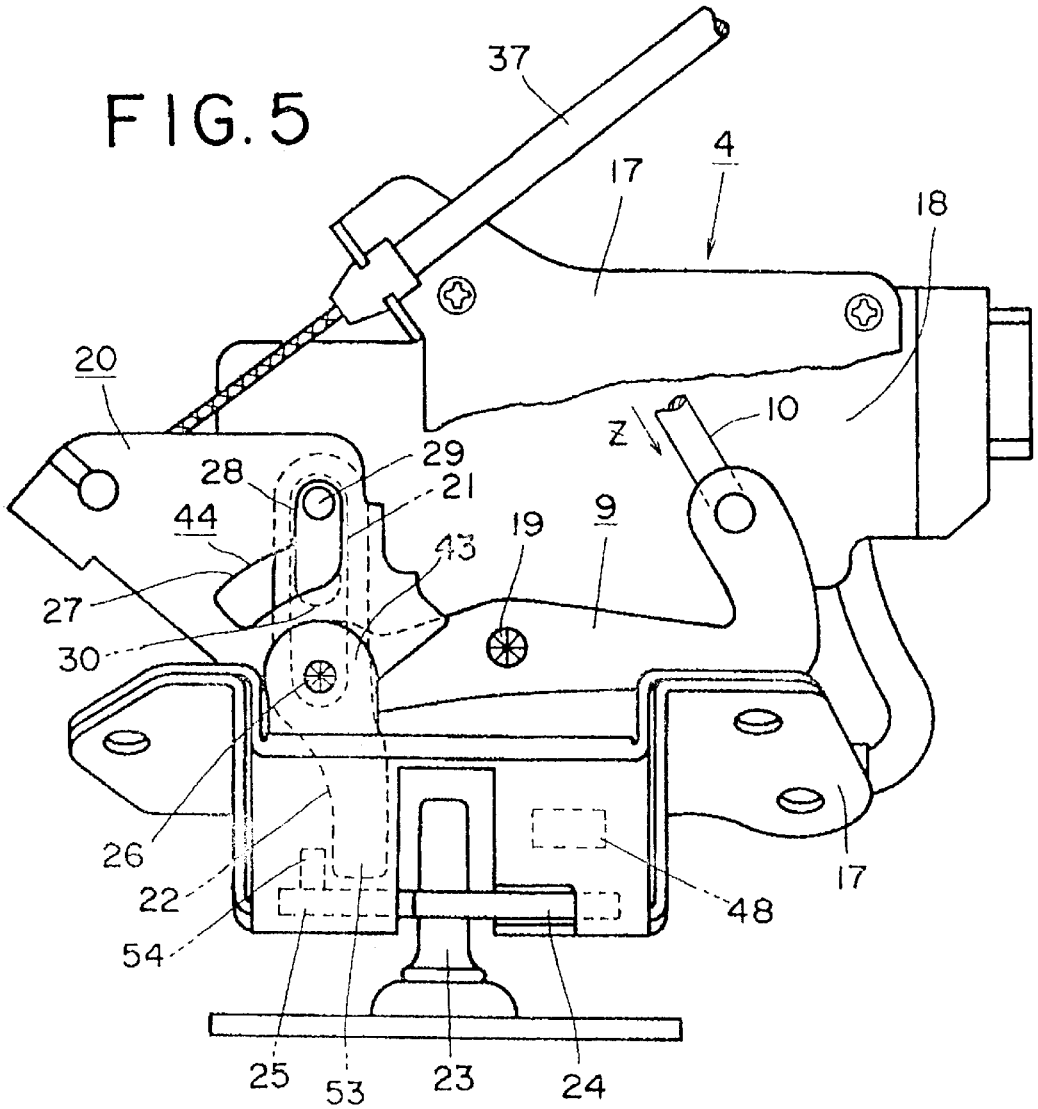
FIG. 5 is a front view of a main latch assembly.
Figure 9:
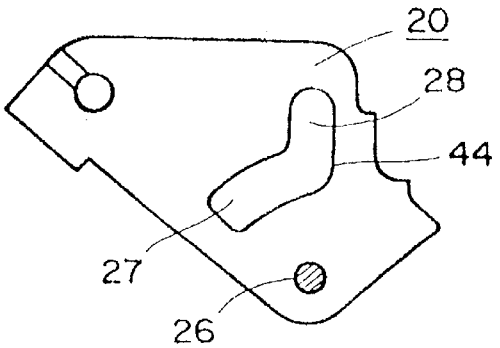
FIG. 9 is a plan view of an open lever of the main latch assembly.
Figure 10:
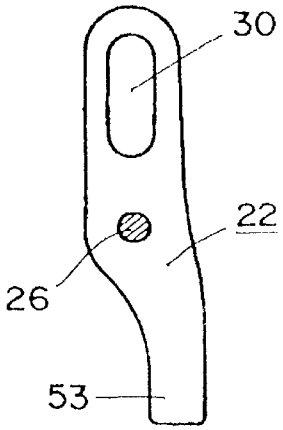
FIG. 10 is a plan view of a ratchet lever of the main latch assembly.
Figure 6:
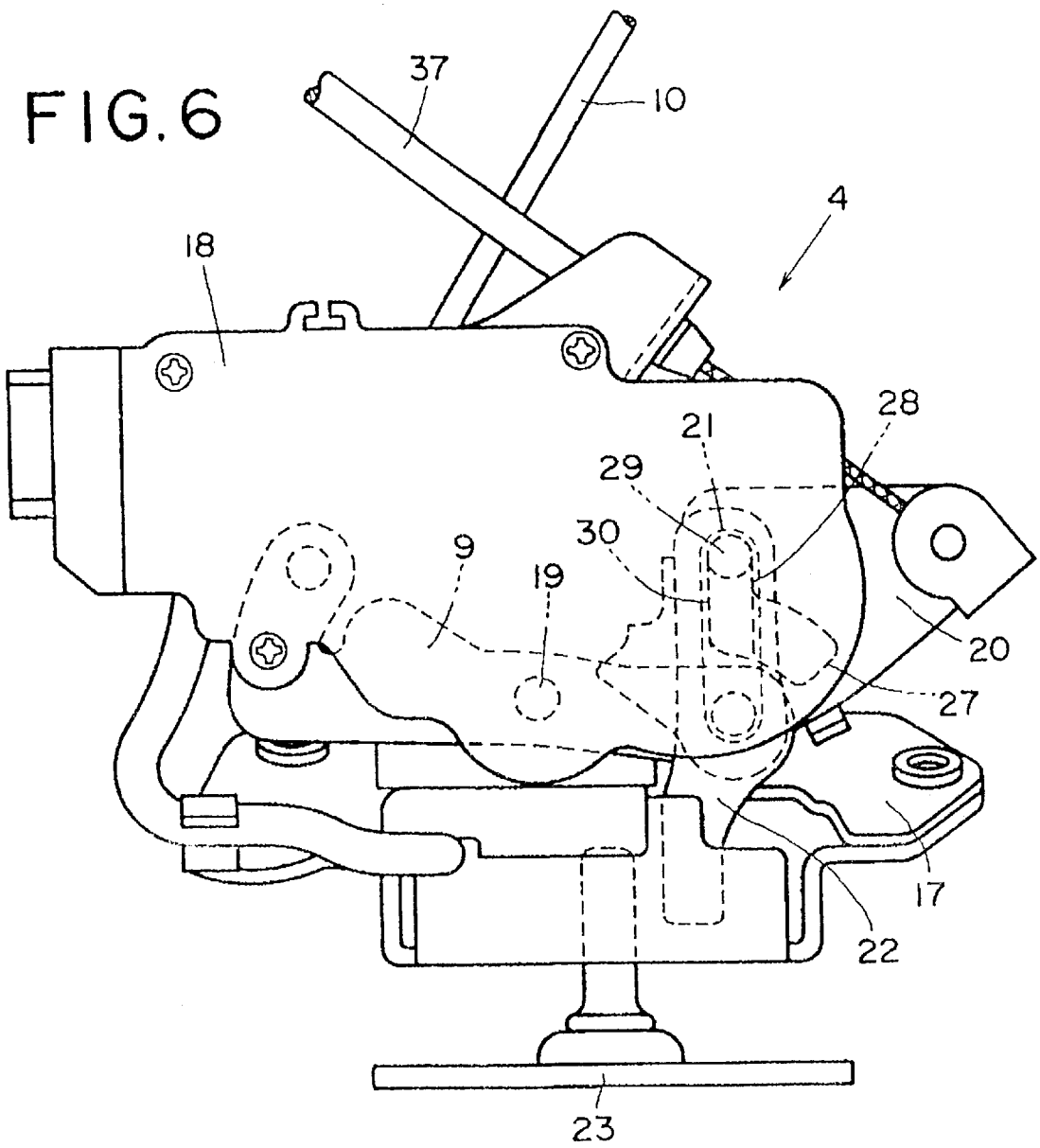
FIG. 6 is a rear view of the main latch assembly.
Figure 11:
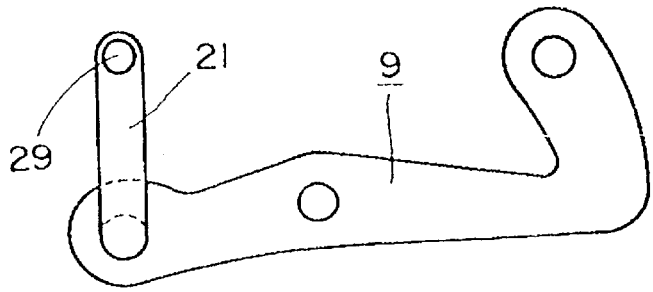
FIG. 11 is a plan view showing a lock lever and a lock link of the main latch assembly.
Figure 7:
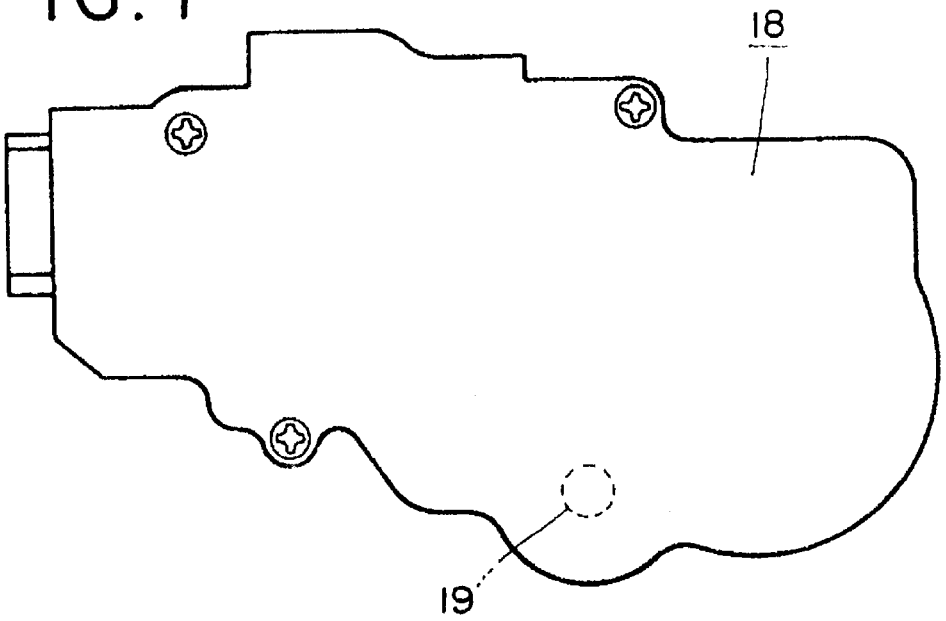
FIG. 7 is a rear view of an actuator for switching a locking mechanism of the main latch assembly.
Figure 8:
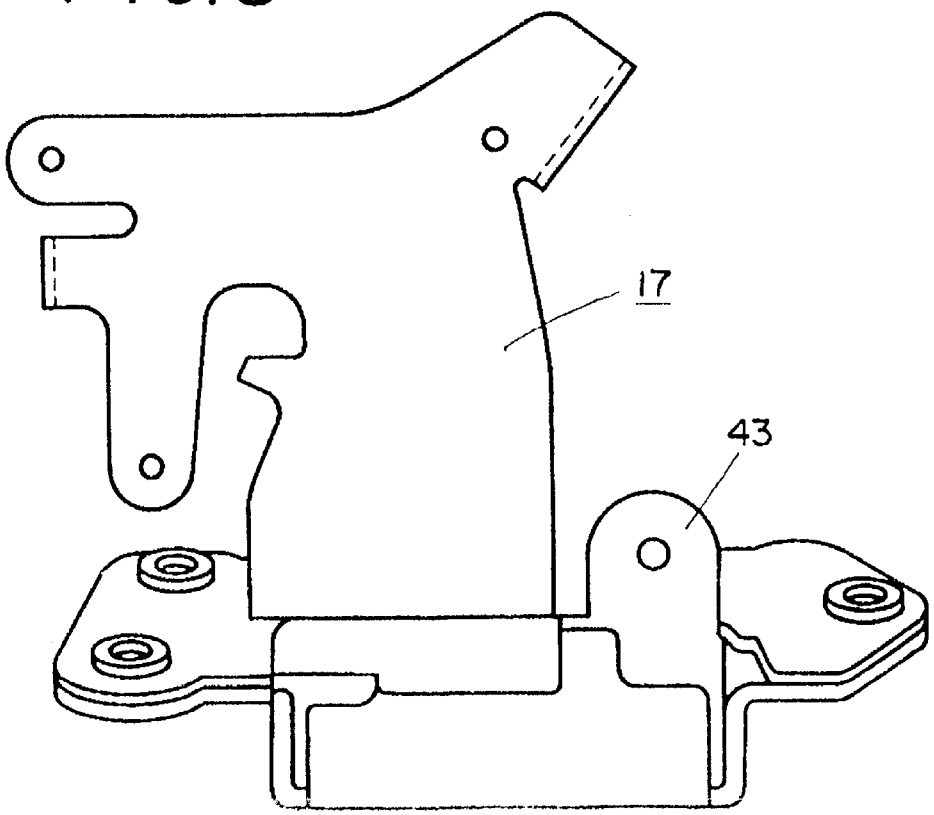
FIG. 8 is a rear view of a frame of the main latch assembly.

The locking mechanism of the main latch assembly 4 has the lock lever 9 and a lock link 21 rotatably attached to an end portion of the lock lever 9. A pin 29 of the lock link 21 is slidably engaged with the groove 44 and the elongated slot 30 such that the pin 29 is slid along the radial direction of the shaft 26 by rotation of the lock lever 9. When the lock lever 9 is located in an unlocked position as shown in FIG. 5, the pin 29 is engaged with the engaging groove 28 of the open lever 20. In the unlocked state when the open lever 20 is rotated clockwise in FIG. 5, the ratchet lever 22 is also rotated clockwise by the engagement of the pin 29 with the engaging groove 28, and the ratchet 25 is then rotated by engagement between the tip end 53 of the ratchet lever 22 with the projection 54 of the ratchet 25 and is released from the latch 24, thereby the back door 2 is opened. When the lock lever 9 is rotated counterclockwise in FIG. 5 to move to a locked position, the lock pin 29 is moved to an inlet of the lost-motion groove 27 of the open lever 20. In this locked state, no rotation of the open lever 20 is transmitted to the ratchet lever 22 so that the back door 2 cannot be opened.

An actuator 18 is fixed to the frame 17. The lock lever 9 is fixed to an output shaft 19 of the actuator 18 such that the lock lever 9 is switched between the locked position and the unlocked position by power of the actuator 18. The actuator 18 is constructed so that it is operated on the basis of operating signals from a switch 48 provided in a position near the latch 24 to detect a closed state of the back door 2, an operating switch (not illustrated) provided in the vicinity of the driver's seat, a transmitter (not illustrated) for remote control, etc.

The switch 48 is turned on when the latch 24 is fully engaged with the main striker 23, i.e., when the back door 2 is fully closed. The switch 48 is electrically connected to the actuator 18 such that the actuator 18 is operated to displace the lock lever 9 into the locked position when the switch 48 is turned on. In such a construction, when the back door 2 is completely closed, the main latch assembly 4 is automatically locked.

Figure 13:
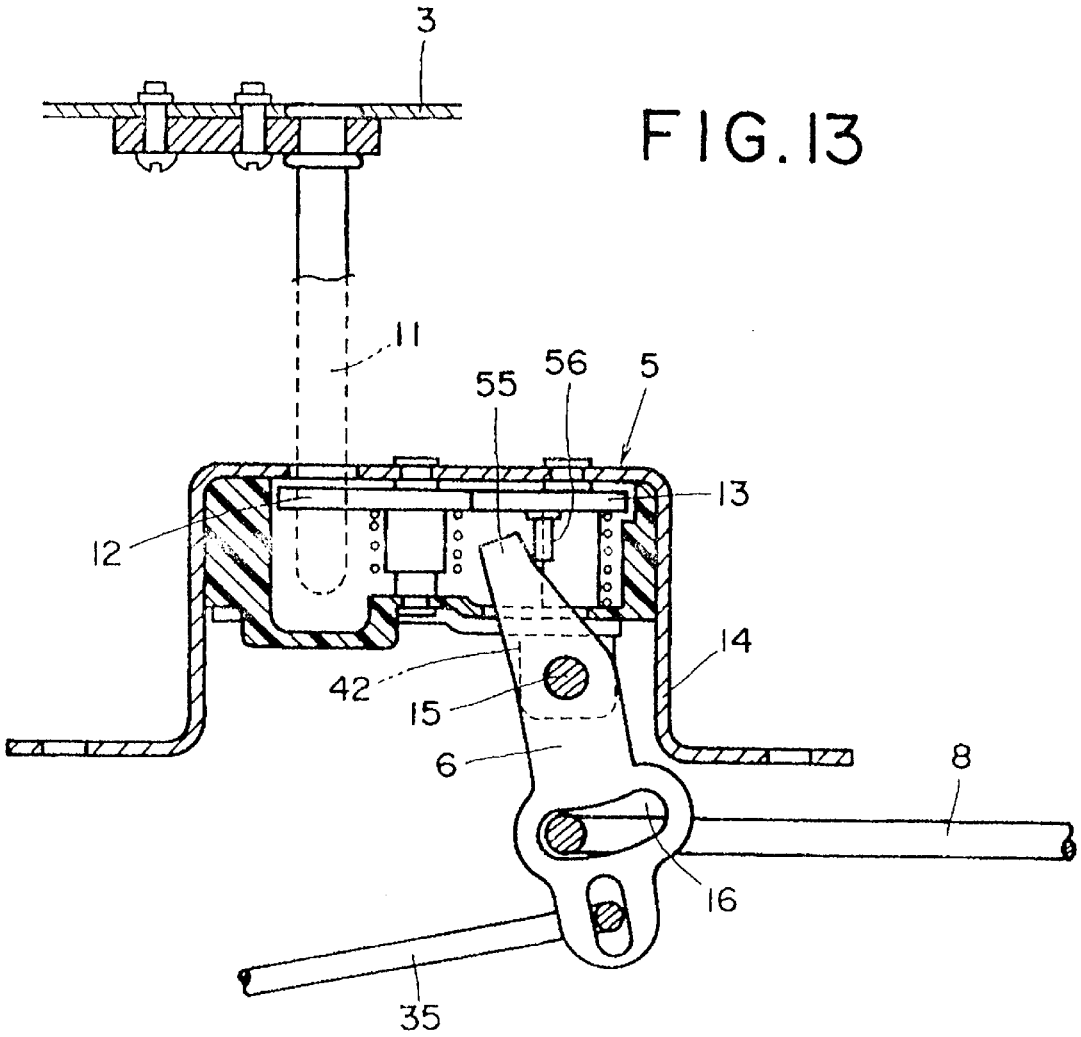
FIG. 13 is a partial sectional view of a sub latch assembly.

The sub latch assembly 5 will be explained with reference to FIG. 13. The sub latch assembly 5 shown in FIG. 13 is designed to be mounted to the back door 2. If the sub latch assembly 5 is attached to the window hatch 3, it is necessary to change an attaching position of the open lever 6 as described later. The sub latch assembly 5 shown in FIG. 13 has a latch 12 which is engageable with the sub striker 11 fixed to the hatch 3 and a ratchet 13 which is engageable with the latch 12 so as to hold the engagement of the latch 12 with the striker 11. The latch 12 and the ratchet 13 basically have the same shapes as the latch 24 and the ratchet 25 of the main latch assembly 4, respectively. The latch 12 and the ratchet 13 are rotatably attached to a frame 14 of the latch assembly 5.

The open lever 6 is pivotally mounted to a projecting piece 42 of the frame 14 by a shaft 15. A tip end 55 of the open lever 6 is opposed to a projection 56 of the ratchet 13 so that the ratchet 13 is separated from the latch 12 when the open lever 6 is rotated. The open lever 6 has an arc elongated hole 16 in which a bent end portion of the rod 8 is slidably engaged. In FIG. 13, when the rod 8 is moved leftward by rotation of the key cylinder 7, the open lever 6 is rotated clockwise to separate the ratchet 13 from the latch 12. In contrast to this, when the rod 8 is moved rightward by rotation of the key cylinder 7, the open lever 6 is not rotated due to a lost-motion formed between the elongated hole 16 and the bent end portion of the rod 8.

If the sub latch assembly 5 is attached to the window hatch 3, the open lever 6 is not attached to the frame 14 of the sub latch assembly 5, but is rotatably attached to the back door 2. In this case, the tip end 55 of the open lever 6 must be opposed to the projection 56 of the ratchet 13 when the window hatch 3 is closed.

Figure 14:
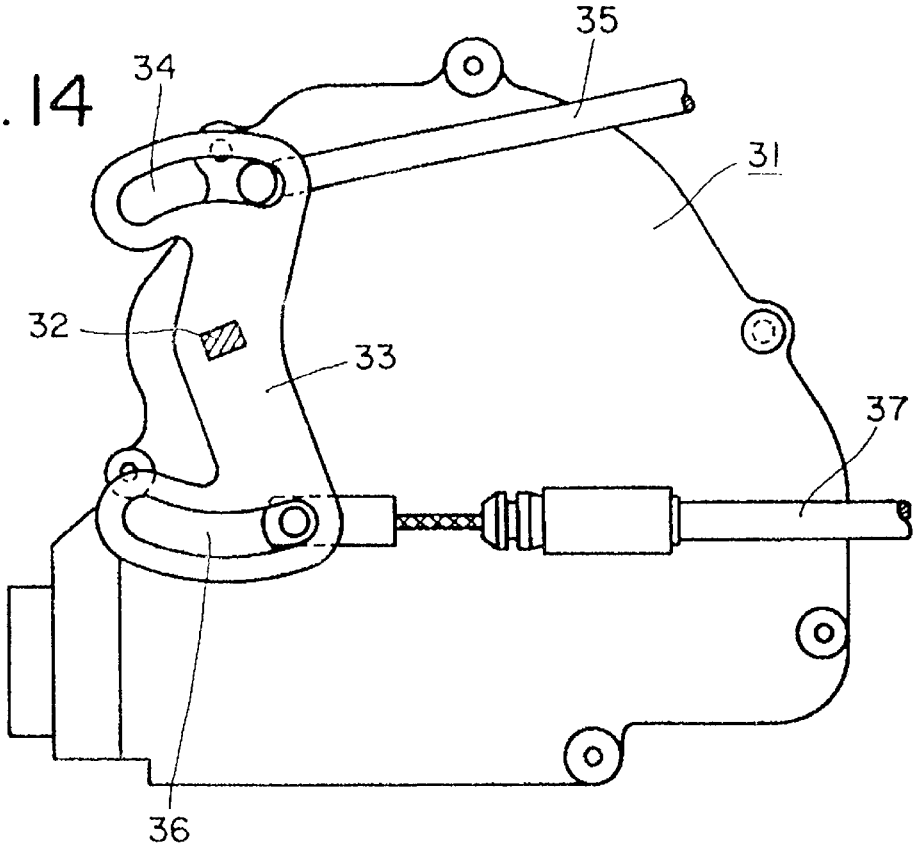
FIG. 14 is a plan view of a motorized opening unit.

The motorized opening unit 31 has an unillustrated motor and an unillustrated reduction gear mechanism, both of which are built in a housing thereof. As shown in FIG. 14, a central portion of the actuator lever 33 is fixed to an output shaft 32 of the motorized opening unit 31. Elongated holes 34 and 36 which are centered on an axis of the shaft 32 are respectively formed in both end portions of the lever 33. A bent end of the rod 35 is slidably engaged with the elongated hole 34, and an end portion of the wire cable 37 is slidably engaged with the elongated hole 36. The actuator lever 33 is arranged so that it pulls only one of the rod 35 and the cable 37 when the actuator lever 33 is rotated in one of rotating directions thereof.

Figure 15:
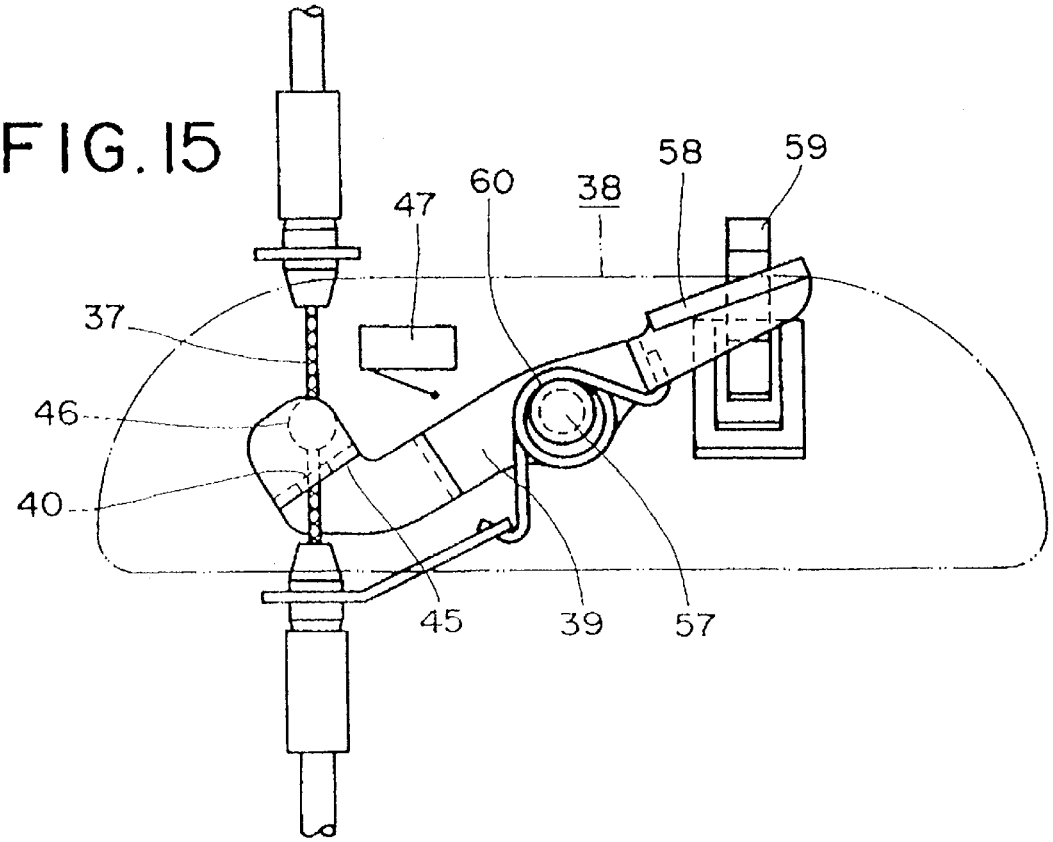
FIG. 15 is a front view showing a connecting relation of an open handle and a wire cable.

The open handle 38 is attached to an outer surface of the back door 2. As shown in FIG. 15, a relay lever 39 is pivotally mounted by a shaft 57 to a casing of the opening handle 38 or the back door 2. An arm 59 of the open handle 38 is opposed to an end portion 58 of the relay lever 39 so that the arm 59 is brought into contact with the end portion 58 to rotate the lever 39 clockwise against resilient force of a spring 60 when the open handle 38 is operated. A bent portion 45 is formed at the other end of the relay lever 39 and has a notch or slit 40 through which the wire cable 37 passes. An engaging ball 46 is fixed to an intermediate portion of the wire cable 37. A gap or distance of the notch 40 is narrower than a diameter of the ball 46, but wider than a diameter of the cable 37. The engaging ball 46 is moved in a direction away from the bent portion 45 and does not rotate the relay lever 39, when the cable 37 is pulled by the motorized opening unit 31. However, when the relay lever 39 is rotated clockwise by operation of the open handle 38, the bent portion 45 of the lever 39 comes into contact with the ball 46 to pull the cable 37 in order to rotate the open lever 20 of the main latch assembly 4. Thus, since the open handle 38 is operatively connected to the intermediate portion of the cable 37 which connects the motorized opening unit 31 with the main latch assembly 4, it is not necessary to provide another connecting means for transmitting rotation of the open handle 38 to the main latch assembly 4.

The switch 47 for detecting an opening operation of the open handle 38 is provided in a position near the relay lever 39. When the open handle 38 is operated, the switch 47 is turned on before the bent portion 45 comes into contact with the engaging ball 46, thereby causing the motorized opening unit 31 to pull the wire cable 37. Thus, when the open handle 38 is manually operated, it is not necessary to pull the wire cable 37 by manual force.

OPERATIONS

When the latch 24 of the main latch assembly 4 is fully engaged with the main striker 23 by closing the back door 2, the switch 48 detects the closed state of the back door 2 and causes the actuator 18 to displace the lock lever 9 into the locked position. Therefore, the back door 2 is automatically locked without failure.

Figure 16A:
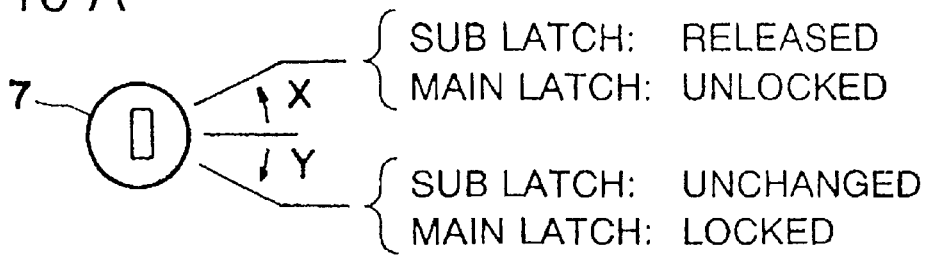
FIGS. 16A to 16E are explanatory views showing the connecting relation of a key cylinder and the main and sub latch assemblies.
Figure 16B:
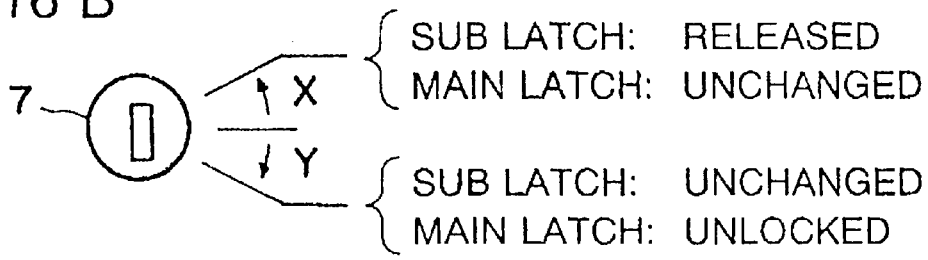
Figure 16C:
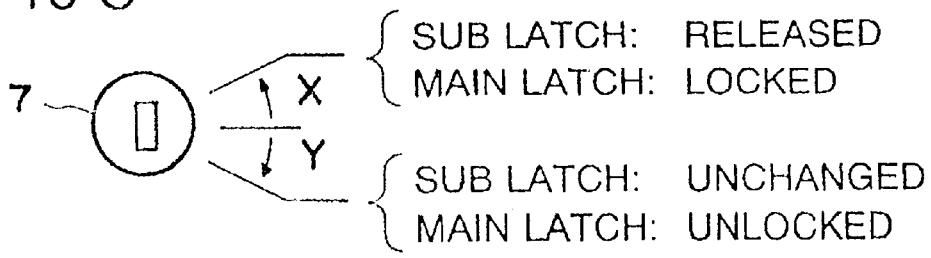
Figure 16D:
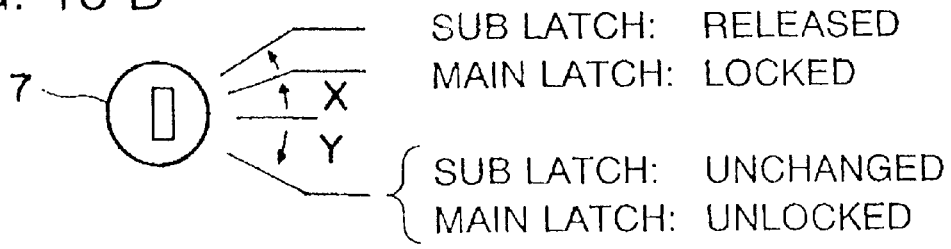
Figure 16E:
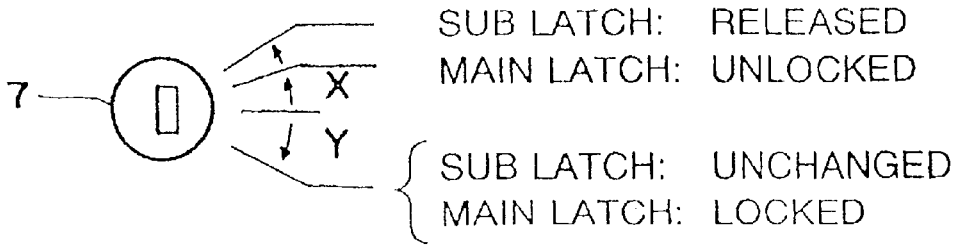

When the key cylinder 7 is rotated by a key operation in the direction of the arrow X while the relation between the key cylinder 7 and the latch assemblies 4, 5 is in a relation shown in FIG. 16A, the rod 8 is moved leftward in FIG. 13, and the open lever 6 of the sub latch assembly 5 is then rotated clockwise, thereby the ratchet 13 is rotated due to the engagement between the tip end 55 and the projection 56 and is released or separated from the latch 12, whereby the window hatch 3 is opened. At the same time, by the rotation of the key cylinder 7 in the direction of the arrow X, the rod 10 is moved in the direction of the arrow Z in FIG. 5 to displace the lock lever 9 into the unlocked position (the lock lever 9 of FIG. 5 is located in the unlocked position). Thereby, the locking mechanism of the main latch assembly 4 is switched to the unlocked state.

In the unlocked state, when the open lever 20 of the main latch assembly 4 is rotated clockwise in FIG. 5 by the motorized opening unit 31 or the open handle 38 through the wire cable 37, the ratchet lever 22 is also rotated clockwise by the engagement of the pin 29 and the engaging groove 28, thereby the ratchet 25 is rotated due to the engagement between the tip end 53 and the projection 54 and is released from the latch 24, whereby the back door 2 is opened.

To the contrary, when the key cylinder 7 is rotated in the direction of the arrow Y in FIG. 16A, the rod 8 is moved rightward in FIG. 13. However, the open lever 6 is not moved by the lost-motion formed between the elongated hole 16 and the bent end of the rod 8. At the same time, by the rotation of the key cylinder 7 in the direction of the arrow Y, the rod 10 is moved in the direction opposite to the arrow Z in FIG. 5 to displace the lock lever 9 into the locked position. Thereby, the locking mechanism of the main latch assembly 4 is switched to the locked state. In the locked state, as the lock pin 29 is moved to the inlet of the lost-motion groove 28 of the open lever 20, the pin 29 cannot transmit the rotation of the open lever to the ratchet lever 22 even when the open lever 20 is rotated clockwise due to the movement of the wire cable 37.. Therefore, the ratchet lever 22 cannot release the ratchet 25 from the latch 24, and the back door 2 is not opened.

The relation of the key cylinder 7 and the latch assemblies 4, 5 shown in FIG. 16A can be easily changed to some other relations, for example, the relations shown in FIGS. 16B to 16E by changing a shape of the key lever 41 and adding or deleting lost-motion couplings. Further, in FIGS. 16D and 16E, the key cylinder 7 is constructed such that the it has two-stage motion in the direction of the arrow X, thereby many variations can be set in the relation of the key cylinder 7 and the latch assemblies 4, 5. The relation between the key cylinder 7 and the latch assemblies 4, 5 should be selected from many variations in accordance with a user's desire and a using object of a vehicle.

In the present invention, the motorized opening unit 31 is operated on the basis of operating signals from the switch 47 for detecting the movement of the open handle 38, the operating switch provided in the vicinity of the driver's seat, and/or the transmitter for remote control, etc. When a signal for releasing the main latch assembly 4 is transmitted to the motorized opening unit 31, the actuator lever 33 is rotated clockwise in FIG. 4 to pull the wire cable 37, and then the open lever 20 of the main latch assembly 4 is rotated clockwise in FIG. 5, thereby if the locking mechanism is in the unlocked state the ratchet 25 is released from the latch 24 as mentioned above. At this time, the rod 35 is not moved by the lost-motion of the elongated hole 34.

When a signal for releasing the sub latch assembly 4 is transmitted to the motorized opening unit 31, the actuator lever 33 is rotated counterclockwise in FIG. 4 to pull the rod 35, and then the open lever 6 of the sub latch assembly 5 is rotated clockwise in FIG. 13, thereby the ratchet 13 is separated from the latch 12 as mentioned above. At this time, the cable 37 is not moved by the lost-motion of the elongated hole 36. It is desirable to construct the motorized opening unit 31 such that it cannot open the window hatch 3 for safety if the back door 2 is in the opening state. To achieve this object, it is sufficient to use a signal from the switch 48 for detecting the closed state of the hatch 3 in control of the motorized opening unit 31.

When the open handle 38 provided on the outer face of the back door 2 is operated, the arm 59 of the open handle 38 comes in contact with the end portion 58 to rotate the relay lever 39 clockwise against the resilient force of the spring 60 in FIG. 15, thereby the bent portion 45 of the relay lever 39 comes in contact with the engaging ball 46 to move the wire cable 37, whereby the open lever 20 of the main latch assembly 4 is rotated clockwise in FIG. 5. Accordingly, when the locking mechanism is not in the locked state, the ratchet 25 is released from the latch 24 and the back door 2 is opened.

The switch 47 for detecting the door-opening operation of the open handle 38 is provided in the vicinity of the open handle 38, if desired. The switch 47 is turned on by detecting the opening operation, thereby causing the motorized opening unit 31 to pull the cable 37 so as to release the ratchet 25 from the latch 24 before the bent portion 45 of the relay lever 39 comes into contact with the ball 46. Therefore, when the open handle 38 is manually operated, it is not necessary to pull the wire cable 37 by manual force.

As mentioned above, the open handle 38 is connected to the intermediate portion of the cable 37 which connects the motorized opening unit 31 and the main latch assembly 4. Therefore, it is not necessary to provide another connecting means for transmitting rotation of the open handle 38 to the main latch assembly 4.

What is claimed is:

1. A latch device arrangement in combination with a vehicle tailgate having a back door rotatably mounted on a vehicle body and a window hatch rotatably mounted on the back door, said latch device arrangement comprising:

a main striker fixed to the vehicle body;

a main latch assembly provided on the back door for holding the back door in a closed state by engaging with the main striker;

a sub striker fixed to the window hatch;

a sub latch assembly provided on the back door for holding the window hatch in a closed state by engaging with the sub striker;

a main open lever provided on the back door for releasing the main latch assembly from the main striker when rotated;

a sub open lever provided on the back door for releasing the sub latch assembly from the sub striker when rotated;

motorized opening means rotatably located on the back door and connected to the main open lever and the sub open lever through a main mechanical connecting means and a sub mechanical connecting means, respectively, for rotating only the main open lever when the motorized opening means is rotated in a given direction and rotating only the sub open lever means when the motorized opening means is rotated in a direction opposite to the given direction; and an open handle provided on an outer surface of the back door for rotating the main open lever;

wherein said open handle is operatively connected to the main mechanical connecting means so that a movement of the open handle is transmitted to the main open lever through the main connecting means.

2. The latch device arrangement according to claim 1, wherein said main mechanical connecting means has an engaging portion which is brought into contact with the open handle to move the main mechanical connecting means for rotating the main open lever when the open handle is rotated.

3. The latch device arrangement according to claim 2, wherein said open handle has a bent portion which comes into contact with the engaging portion when the open handle is rotated, and said engaging portion of the main mechanical connecting means is moved in a direction away from the bent portion when said main mechanical connecting means is moved by the motorized opening means.

4. The latch device arrangement according to claim 3, further comprising a relay lever provided in the vicinity of the open handle and rotated by the open handle, said bent portion being formed in the relay lever.

5. The latch device arrangement according to claim 1, further comprising a switch for detecting a door-opening operation of the open handle and electrically connected to the motorized opening means so that the motorized opening means is operated in the given direction when the switch detects the door-opening operation of the open handle.

6. The latch device arrangement according to claim 1, wherein a key cylinder is provided on the back door and is connected to the sub open lever to rotate the sub open lever.

7. The latch device arrangement according to claim 1, wherein said main latch assembly has a locking mechanism which has a locked state for disabling an operation of the main open lever and an unlocked state for enabling the operation of the main open lever.

8. The latch device arrangement according to claim 7, wherein said main latch assembly has an actuator for displacing the locking mechanism to the locked state and the unlocked state.

9. The latch device arrangement according to claim 1, wherein a key cylinder is provided on the back door and is connected to the sub open lever to rotate the sub open lever.

10. The latch device arrangement according to claim 8, further comprising a switch for detecting a closed state of the back door and electrically connected to the actuator so that the actuator is operated to displace the locking mechanism into the locked state when the switch detects the closed state of the back door.

11. The latch device arrangement according to claim 1, further comprising a switch for detecting a closed state of the back door and electrically connected to the motorized opening means so that the motorized opening means cannot be operated in the opposite direction when the switch does not detect the closed state of the back door.

12. A latch device arrangement in combination with a vehicle tailgate having a back door rotatably mounted on a vehicle body and a window hatch rotatably mounted on the vehicle body, said latch device arrangement comprising:

a main striker fixed to the vehicle body;

a main latch assembly provided on the back door for holding the back door in a closed state by engaging with the main striker;

a sub striker fixed to the back door;

sub latch assembly provided on the window hatch for holding the window hatch in a closed state by engaging with the sub striker, mounted on the back door;

a main open lever provided on the back door for releasing the main latch assembly from the main striker when rotated;

a sub open lever provided on the back door for releasing the sub latch assembly from the sub striker when rotated;

a motorized opening means rotatably located on the back door and connected to the main open lever and the sub open lever through a main mechanical connecting means and a sub mechanical connecting means, respectively, for rotating only the main open lever when the motorized opening means is rotated in a given direction and rotating only the sub open lever when the motorized opening means is rotated in a direction opposite to the given direction; and an open handle provided on an outer surface of the back door for rotating the main open lever;

wherein said open handle is operatively connected to the main mechanical connecting means so that a movement of the open handle is transmitted to the main open lever through the main connecting means.

13. A latch device arrangement in combination with a vehicle tailgate having a back door rotatably mounted on a vehicle body and a window hatch rotatably mounted on the vehicle body, said latch device arrangement comprising:

a main striker fixed to the vehicle body;

a main latch assembly provided on the back door for holding the back door in a closed state by engaging with the main striker;

a sub striker fixed to the window hatch;

a sub latch assembly provided on the back door for holding the window hatch in a closed state by engaging with the sub striker, mounted on the window hatch;

a main open lever provided on the back door for releasing the main latch assembly from the main striker when rotated;

a sub open lever provided on the back door for releasing the sub latch assembly from the sub striker when rotated;

motorized opening means rotatably located on the back door and connected to the main open lever and the sub open lever through a main mechanical connecting means and a sub mechanical connecting means, respectively, for rotating only the main open lever when the motorized opening means is rotated in a given direction and rotating only the sub open lever when the motorized opening means is rotated in a direction opposite to the given direction; and an open handle provided on an outer surface of the back door for rotating the main open lever;

wherein said open handle is operatively connected to the main mechanical connecting means so that a movement of the open handle is transmitted to the main open lever through the main connecting means.

* * * * *